US005225685A

United States Patent [19]

Bowden, Sr.

[11] Patent Number: 5,225,685

[45] Date of Patent: Jul. 6, 1993

[54] CONSTRUCTION MODULE PROTECTING AGAINST EMISSIONS FROM RADIO ACTIVE MATERIAL AND METHOD

[75] Inventor: Andrew V. Bowden, Sr., Columbia, S.C.

[73] Assignee: Southern Metal Works, Inc., Columbia, S.C.

[21] Appl. No.: 833,886

[22] Filed: Feb. 11, 1992

[51] Int. Cl.[5] ..... G21F 3/00

[52] U.S. Cl. ..... 250/517.1; 250/515.1

[58] Field of Search ..... 250/517.1, 515.1

[56] References Cited

U.S. PATENT DOCUMENTS 2,932,745 4/1960 Alberti et al. ..... 250/517.1

4,400,623 8/1983 Jacobson ..... 250/517.1

*Primary Examiner*—Jack I. Berman

*Attorney, Agent, or Firm*—Ralph Bailey

[57] ABSTRACT

A construction module effective against emissions from radio active material contains shielding material A encapsulated in molded plastic material B which may be made by using the molded plastic material as a form and then filling the form with shielding material. A special joint structure provides a full thickness of shielding material.

20 Claims, 2 Drawing Sheets

CONSTRUCTION MODULE PROTECTING AGAINST EMISSIONS FROM RADIO ACTIVE MATERIAL AND METHOD

BACKGROUND OF THE INVENTION

This invention relates to encapsulated construction modules such as shielding panels, bricks and other the like including molded plastic material having an interior filled with a shielding media and method of making same.

The prior art includes containers for housing radio active material which are thereafter wrapped with plastic material. Also bricks filled with lead pellets have been provided. Such soft bricks are beanbag designs filled with lead pellets. Such bricks are useful for packing around objects such as pipes, but they are not well suited to wall construction. Furthermore, lead pellets do not have the density of solid lead, so they offer reduced shielding. At joints between the soft bricks, radiation leakage is even more pronounced. Moreover, contact with shielding material such as lead should be avoided so that the molded plastic form protects against contact by the individual with the shielding material. The plastic encapsulating material also avoids contamination of the shielding material because the smooth surface is easily decontaminated and contact with liquid wastes, for example, is avoided.

Accordingly, it is an important object of this invention to provide a molded encapsulating plastic form containing shielding material in order to facilitate manufacture and protect against contact with the shielding material while providing a surface which is easily decontaminated.

SUMMARY OF THE INVENTION

Depending on each user's needs, the shielding media utilized in the construction modules may be concrete, water, sand, or solid lead and the like. A special enlarged interfitting joint provides full shielding, and the use of an exterior as of molded polyethylene and the like over the shielding media avoids contamination of the shielding material while providing a surface which facilitates decontamination.

For example, solid shielding bricks for construction of walls of various heights and lengths are provided of similar constructions. The shape of the bricks will improve shielding efficiency at the joints between bricks. The joints may be of chevron design, 45° angle configuration providing the shielding media, usually solid lead, and will be encased in polyethylene polymer. A panel construction includes a molded polyethylene form filled with concrete.

The use of a polyethylene exterior provides several benefits over existing designs. First, personnel are protected from contact with hazardous media such as lead, and second, it is possible to remove surface contaminants. The construction of the molded polymer shapes permit molten lead or concrete and the like to be poured into the molded plastic forms.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A construction module for use in protecting personnel against emissions from radio active material includes a shaped member A suitable for assembly with other shaped members to form a shielding structure. The shaped members A are formed from suitable shielding material, such as concrete, water, sand or lead, capable of excluding passage of emissions from radio active material and having adjoining surfaces for reception closely adjacent complementary surfaces of other shaped members. A synthetic polymeric material B, having been formed by molding, engages and extends over an exterior surface of the shaped member forming a hardened coating layer which is sufficiently stiff for protecting the shielding material from contamination by exposure to radio active material and serving as a readily decontaminated surface to avoid exposure of personnel to emissions from radio active material.

Thus, an encapsulated construction module is formed suitable for assembly as a structure to shield personnel and which is easily decontaminated avoiding exposure to emissions from radio active material.

The structure further includes a joint construction for assembly of the modules wherein a full thickness of shielding material is afforded with full coverage of adjoining surfaces of respective modules by the hardened molded coating layer of synthetic polymeric material. For example, the structure at the joint may be formed by modules each having a bulbous arcuate adjoining portion C on one side, and a complementary arcuate end D on the other side. The bulbous portion has a recess accommodating a complementary end of an adjoining construction module. Alternatively the joint may be chevron shaped in cross section as illustrated at E.

The hardened coating layer may be molded in situ upon the shielding material as by dipping or otherwise molding, depositing or forming, or preferably the hardened coating layer is first molded as a shape or form and then filled with shielding material.

Figure 2:
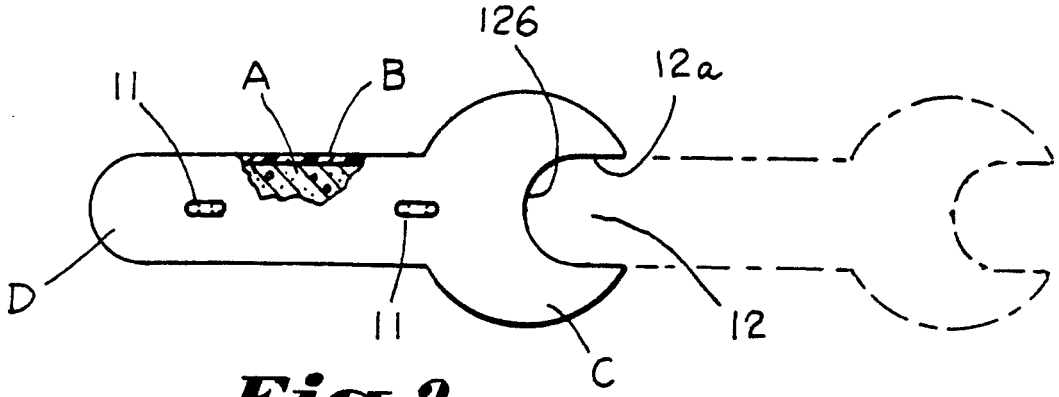
FIG. 2 is a top plan view of a panel of FIG. 1.
Figure 1:
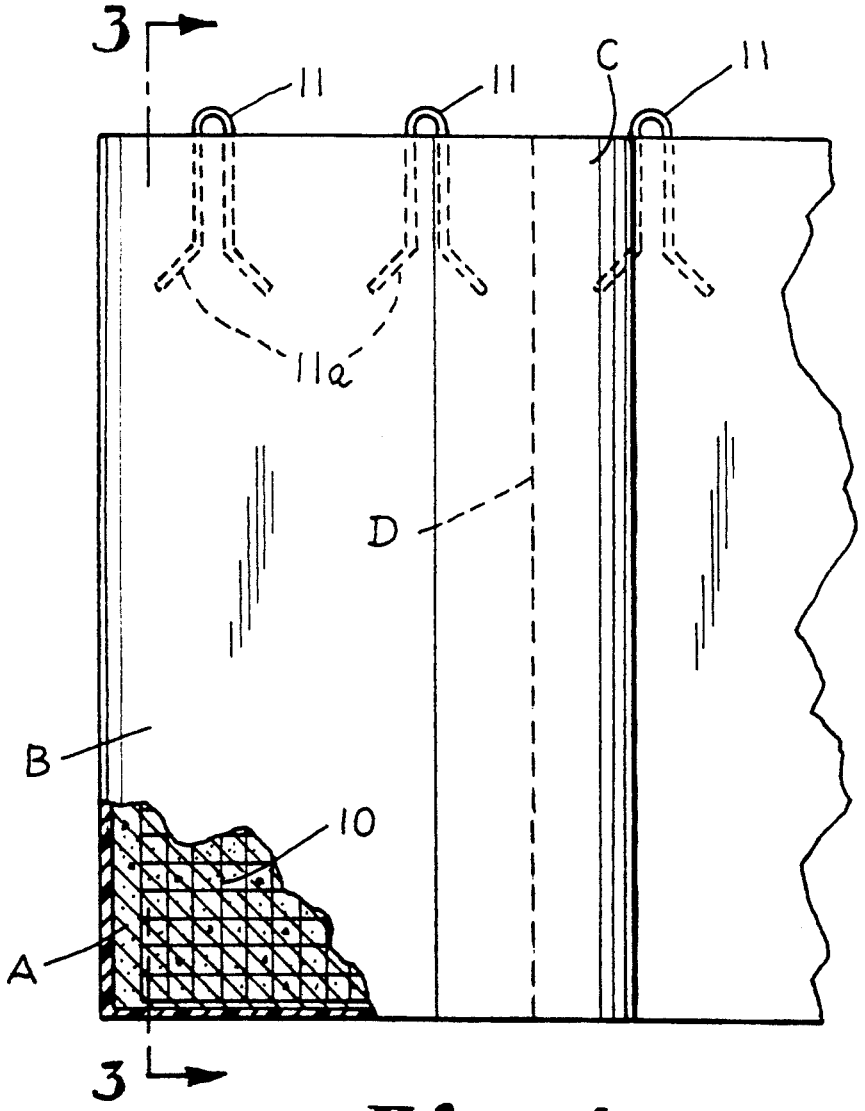
FIG. 1 is a front elevation illustrating a wall panel and wall constructed in accordance with the present invention.
Figure 3:
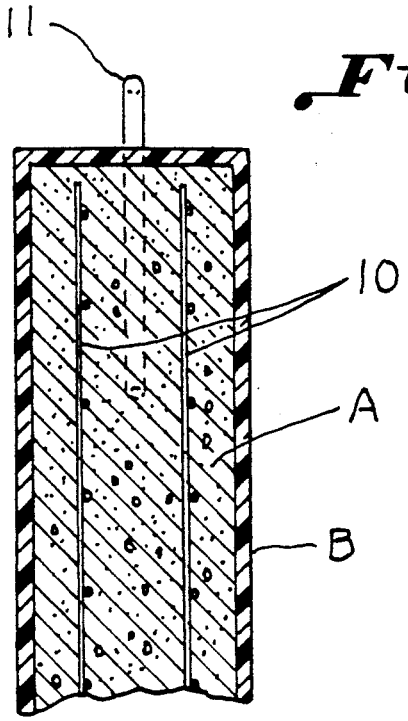
FIG. 3 is a transverse sectional elevation taken on the line 3—3 in FIG. 1.
Figure 4:
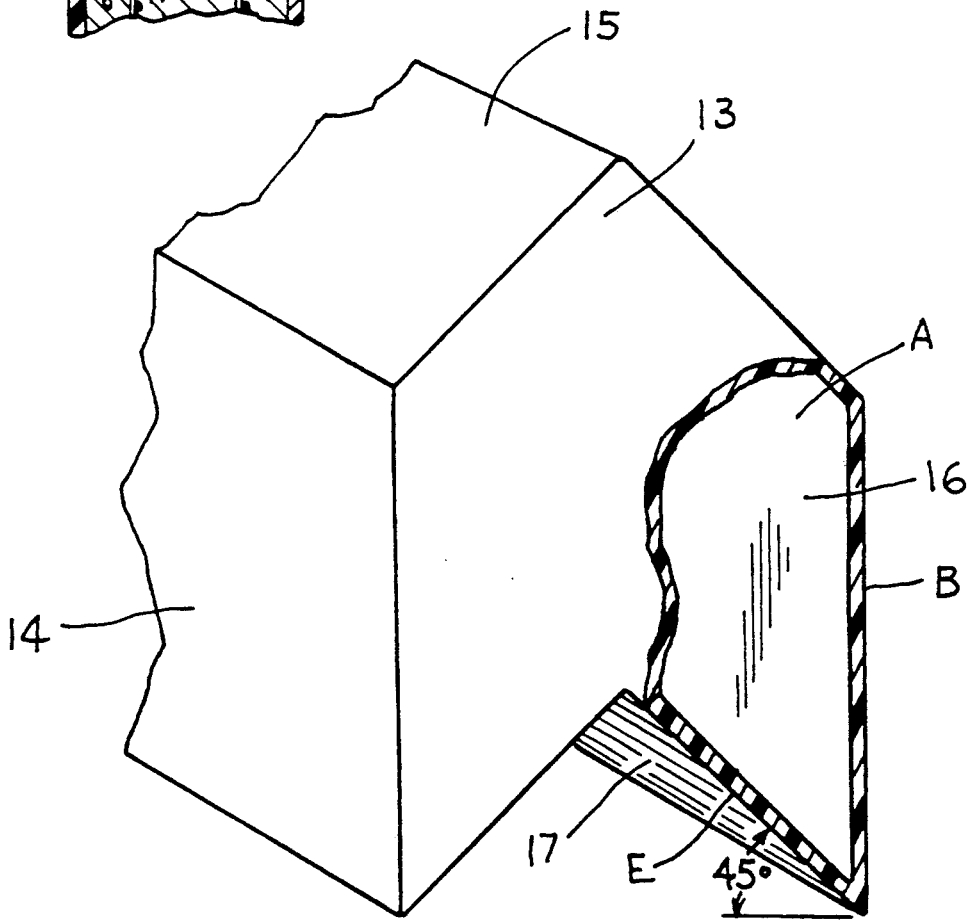
FIG. 4 is an end perspective view of a brick constructed in accordance with the present invention with parts broken away for purposes of illustration.

Referring more particularly to FIGS. 1-3, the shielding material is illustrated at A and is formed as a panel which includes a wire reenforcing member 10. A plurality of spaced lifter lugs are illustrated at 11 which have suitable legs 11*a* embedded in the concrete. It will be observed that a recess 12 has straight sides 12*a* and an arcuate interior 12*b* for accommodating the arcuate end D of the panel as is illustrated in FIG. 1. FIG. 4 illustrates a chevron construction E which has an end 13 with front 14 and top 15. Chevron like joints may be provided as shown or at the ends of the bricks wherein the chevron points in at a 45° angle on one end and out at a 45° angle at the other end. In FIG. 4 the shielding material A is provided in the form of lead as illustrated at 16. A complementary lower portion 17 is provided.

Thus, the joint structure is an interengaging construction formed by opposing portions of adjacent modules. Preferably, the panels of FIGS. 1-3 and perhaps the brick of FIG. 4 may be constructed of concrete as a shielding material. The brick is illustrated as and may preferably be constructed of lead.

The synthetic polymeric material is preferably a polyethylene polymer or other suitable thermoplastic tough polymeric material. Certain thermo-setting polymers may also be used. The hardened coating layer A may be formed in situ about concrete as by a suitable molding process such as rotational molding.

It is preferable to construct a form utilizing the hardened coated layer as a relatively rigid container and then filling the container with shielding material thereby acting as a form for pouring in the shielding material and containing same while setting up. In the case of the brick of FIG. 4 the shielding material is lead and is poured into the formed hardened plastic coating layer which acts as a mold when filled with the molten lead.

Rotational molding is a suitable molding technique wherein a hollow mold containing polymer powder is mounted on a rotational device and heated in an oven. The mold rotates on one or more axes. Heat fuses the polymer to the sides of the mold while rotation assures the proper distribution of the polymer to produce a mold or form of desired uniform thickness. After the mold is removed from the oven and cooled, it is separated from the polymer form. The mold is cleaned, refilled and reheated. The fabricated polymer form shape can be filled with whatever shielding media is most appropriate. Preferably the thickness of the plastic polymer encapsulation molding material will be from about $\frac{1}{8}$ to $\frac{3}{8}$ inches in order to provide sufficient rigidity and toughness.

The shielding media thickness and material type may be varied depending upon the specific shielding requirements. Likewise, the molded polymer which encases the shielding media may also be varied in thickness and material type depending upon specific environmental conditions and requirements.

The molded polymer protects the shielding media from adverse conditions and possible damage such as cracking and chipping due to impact with other objects. It also provides protection against elements such as liquid absorption. Since the molded polymer surface is very smooth, it can easily be wiped clean of liquids and other surface contaminants. While a clean, uncontaminated surface is safer for personnel, the molded polymer exterior further enhances safety by preventing contact with potentially hazardous shielding media such as lead.

The shielding panel designs have a surface made of a polymer such as polyethylene encapsulating an interior filled with a shielding media. Depending on the user's requirements, the shielding media may be concrete, water, sand, lead pellets, solid lead, or another media. Reinforcement materials may be added to the media whenever necessary to provide additional strength or rigidity. For instance, reinforcement wire may be added to concrete media. The panels may be varied in height, length, and width to accommodate a range of site conditions.

Bricks are also made of a molded polymer encasing a shielding media such as concrete, sand, water, lead pellets solid lead, or other media. They can be used to construct walls of various heights and lengths. The size and shape of the brick may be varied depending upon requirements. Such bricks made of sold lea encapsulated in molded polymer provide greater shielding protection than soft bricks or composite bricks and are safer than un-encapsulated solid lead.

Other designs for bricks currently on the market include solid lead bricks with exposed lead surfaces, and composite bricks composed of a non-homogeneous mixture of lead pellets distributed throughout a plastic shape. The former design is impossible to decontaminate and exposes personnel to a hazardous material. The latter provides reduced shielding due to a reduction in density.

While a preferred embodiment of the invention has been described using specific terms, such description is for illustrative purposes only, and it is to be understood that changes and variations may be made without departing from the spirit or scope of the following claims.

What is claimed is:

1. A construction module for use in protecting personnel against emissions from radio active material comprising:

a shaped member suitable for assembly with other shaped members to form a structure for shielding personnel;

said shaped members being formed from suitable shielding material capable of excluding passage of emissions from radio active material and having adjoining surfaces for reception closely adjacent complementary surfaces of other shaped members; and a synthetic polymeric material having been formed by molding to engage and extend over an exterior surface of said shaped member forming a hardened coating layer protecting the shielding material from contamination by exposure to radio active material and serving as a readily decontaminated surface to avoid exposure of personnel to emissions from radio active material;

whereby an encapsulated construction module is formed suitable for assembly as a structure to shield personnel and which is easily decontaminated avoiding exposure to emissions from radio active material.

2. The structure set forth in claim 1 including a joint construction for assembly of said modules wherein a full thickness of shielding material is afforded with full coverage of adjoining surfaces of respective modules by said hardened coating lay on of molded synthetic polymeric material.

3. The structure set forth in claim 2 wherein said joint is an interengaging structure formed by opposing portions of adjacent modules.

4. The structure set forth in claim 3 wherein said joint is chevron shaped in cross section, end surfaces of adjoining shaped members forming an angle of 45° to each other.

5. The structure set forth in claim 3 wherein said joint is formed by modules each having a bulbous arcuate opposing portion on one side, and a complementary arcuate end on the other side, said bulbous portion having a recess accommodating a complementary end of an adjoining construction module.

6. The structure set forth in claim 1, prepared by the process of molding said hardened coating layer in situ upon said shielding material.

7. The structure set forth in claim 6 wherein said shielding material is concrete.

8. The structure set forth in claim 1, prepared by the process of molding said hardened coating layer as a shape and then filling said shape with shielding material.

9. The structure set forth in claim 8 wherein said shielding material is lead.

10. The structure set forth in claim 1 wherein said synthetic polymeric material is polyethylene polymer.

11. The structure set forth in claim 10, prepared by the process of molding said hardened coating layer by rotational molding and filling said layer with concrete shielding material.

12. The structure set forth in claim 1 wherein said construction module is a panel.

13. The structure set forth in claim 1 wherein said construction module is a brick.

14. The method of making a construction module for use in protecting personnel against emissions from radio active material comprising the steps of:

forming a shaped member suitable for assembly with other shaped members to form a structure for shielding personnel;

said shaped members being formed from suitable shielding material capable of excluding passage of emissions from radio active material and having adjoining surfaces for reception closely adjacent complementary surfaces of other shaped members; and molding a synthetic polymeric material to engage and extend over an exterior exposed surface of said shaped member forming a hardened coating layer protecting the shielding material from contamination by exposure to radio active material and serving as a readily decontaminated surface to avoid exposure of personnel to emissions from radio active material;

whereby an encapsulated construction module is formed suitable for assembly as a structure to shield personnel and which is easily decontaminated avoiding exposure to emissions from radio active material.

15. The method set forth in claim 14 including forming said shaped member from concrete.

16. The method set forth in claim 14 including forming said hardened coating layer as a container, and then filling said container with shielding material.

17. The method set forth in claim 16 wherein said shielding material is lead poured as molten material into said container.

18. A molded shape for use in a construction module for shielding personnel against emissions from radio active material having a shaped member suitable for assembly with other shaped members to form a structure, said shaped members being formed from suitable shielding material capable of excluding passage of emissions from radio active material and having adjoining surfaces for reception closely adjacent complementary surfaces of other shaped members, comprising:

a synthetic polymeric material having been formed by molding to engage and extend over an exterior surface of said shaped member forming a hardened coating layer protecting the shielding material from contamination by exposure to radio active material and serving as a readily decontaminated surface to avoid exposure of personnel to emissions from radio active material; and said hardened coating layer being first molded as a shape and then said shape filled with shielding material;

whereby an encapsulated construction module is formed suitable for assembly as a structure to shield personnel and which is easily decontaminated avoiding exposure to emissions from radio active material.

19. The structure set forth in claim 18 including a joint construction for assembly of said modules wherein said hardened coating layer of molded synthetic polymeric material contains a full thickness of shielding material.

20. The structure set forth in claim 18, prepared by the process of making said shape by rotational molding.

* * * * *